US010287827B2

(12) United States Patent
Altunlu et al.

(10) Patent No.: US 10,287,827 B2
(45) Date of Patent: May 14, 2019

(54) LOW BREAK OUT SAFETY JOINT AND METHOD FOR RELEASABLY CONNECTING A TUBING EXPANSION ASSEMBLY TO A DRILL STRING

(71) Applicant: SHELL OIL COMPANY, Houston, TX (US)

(72) Inventors: Can Altunlu, Rijswijk (NL); Wissam Assaad, Rijswijk (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 215 days.

(21) Appl. No.: 15/398,501

(22) Filed: Jan. 4, 2017

(65) Prior Publication Data

US 2017/0204683 A1 Jul. 20, 2017

Related U.S. Application Data

(63) Continuation of application No. PCT/EP2016/065522, filed on Jul. 1, 2016.

(30) Foreign Application Priority Data

Jul. 1, 2015 (EP) ..... 15174878

(51) Int. Cl.
*E21B 17/06* (2006.01)
*E21B 43/10* (2006.01)

(52) U.S. Cl.
CPC ..... *E21B 17/06* (2013.01); *E21B 43/105* (2013.01)

(58) Field of Classification Search
CPC ..... E21B 17/06
See application file for complete search history.

(56) References Cited

U.S. PATENT DOCUMENTS

| | | | |
|---|---|---|---|
| 2003/0168859 | A1 | 9/2003 | Watts |
| 2004/0069498 | A1 | 4/2004 | Simpson et al. |
| 2004/0108119 | A1 | 6/2004 | Maguire et al. |
| 2009/0283322 | A1 | 11/2009 | Dove |
| 2011/0011646 | A1 | 1/2011 | Giroux et al. |
| 2013/0319655 | A1 | 12/2013 | Schultz et al. |

FOREIGN PATENT DOCUMENTS

| | | |
|---|---|---|
| WO | WO2012104257 | 8/2012 |

*Primary Examiner* — Giovanna C. Wright
*Assistant Examiner* — Kristyn A Hall

(57) ABSTRACT

A low break out screw threaded safety joint for releasably connecting a Bottom Hole Assembly (BHA) of a well tubular expansion assembly to a drill string comprises a pair of intermeshing TOothed MAte (TOMA) rings (24) with intermeshing sawtooth profiles (25,26) teethed profiles that have a low break out performance upon reverse rotation of the drill string relative to the BHA, which may be stuck within the wellbore.

21 Claims, 2 Drawing Sheets

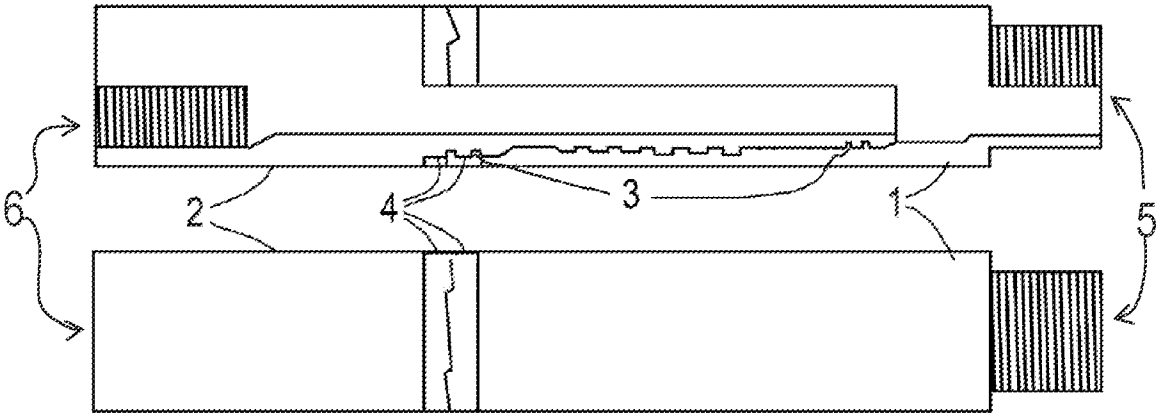
FIG. 1A
FIG. 1B
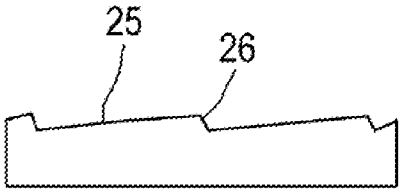
FIG. 2C
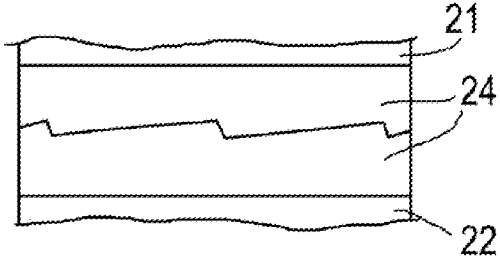
FIG. 2B
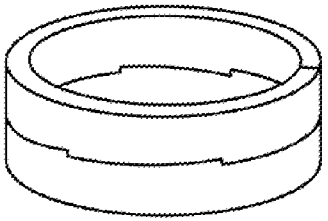
FIG. 2A

LOW BREAK OUT SAFETY JOINT AND METHOD FOR RELEASABLY CONNECTING A TUBING EXPANSION ASSEMBLY TO A DRILL STRING

CROSS REFERENCE TO EARLIER APPLICATION

This application is a continuation of International application No. PCT/EP2016/065522, filed on 1 Jul. 2016, which claims the benefit of European Application No. 15174878.7, filed 1 Jul. 2015.

FIELD OF THE INVENTION

The invention relates to a low break out safety joint and method for releasably connecting a tubing expansion assembly to a drill string.

BACKGROUND OF THE INVENTION

A known well tubular expansion system and method are disclosed in International patent application WO 2012/104257.

In this known method a well tubular is expanded by pulling an expansion cone therethrough.

A problem with this known method is that the expansion cone may get stuck in the partially expanded tubular. Downhole safety joints for releasing a drill string from a stuck Bore Hole Assembly are known from U.S. patent applications 2013/0319655 and 2003/0168859. These known safety joints are configured to collapse or release upon jarring and/or reverse rotation of the drill string in a direction opposite to the direction of rotation during normal drilling operations. The forces required for this collapse and/or release are still substantial to avoid inadvertent collapse and/or release during normal drilling operations.

There is a need for an improved low break out safety joint and method for releasably connecting a tubing expansion assembly to a drill string that is reliable and does not require large release forces.

SUMMARY OF THE INVENTION

In accordance with the invention there is provided a method for releasably connecting a Bottom Hole Assembly (BHA) of a tubular expansion assembly to a drill string using a low break out torque screw threaded safety tool joint comprising a pair of intermeshing TOothed Mate (TOMA) rings, with sawtooth profiles having a low break out performance upon rotation of the drill string relative to the BHA in a direction opposite to a direction of rotation of the drill string during normal drilling operations.

In accordance with the invention there is furthermore provided a low break out safety joint for releasably connecting a Bottom Hole Assembly (BHA) of a tubular expansion assembly to a drill string using a low break out torque screw threaded safety tool joint comprising a pair of intermeshing TOothed Mate (TOMA) rings, with sawtooth profiles having a low break out performance upon rotation of the drill string relative to the BHA in a direction opposite to a direction of rotation of the drill string during normal drilling operations.

Optionally the sawtooth profile of each TOMA ring has:

- a load wedge angle (90°-β) between 4 and 6, optionally 5 degrees;

- a relief wedge angle (90°-θ) which is smaller than a thread helix angle;
- a friction coefficient at coarse threads (μ) between 0.07 and 0.16;
- a friction coefficient on the contact surface of wedge-type rings ($\mu_t$) between 0.06 and 0.14;
- a tooth height (h) smaller than a pitch of the screw thread; and/or
- six wedge teeth ($n_t$).

These and other features, embodiments and advantages of the low break out release method and low break out safety joint according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

BRIEF DESCRIPTION OF THE DRAWINGS

FIG. 1A depicts a quarter section view of a low break out safety tool joint according to an embodiment of the invention;

FIG. 1B depicts a side view of the low break out safety tool joint of FIG. 1A;

FIG. 2A is a perspective view of the low break out safety tool joint according to an embodiment of the invention;

FIG. 2B is a side view of the low break out safety tool joint of FIG. 2A;

FIG. 2C is a side view of one of the wedge type rings;

DETAILED DESCRIPTION OF THE DEPICTED EMBODIMENTS

Figure 3A:
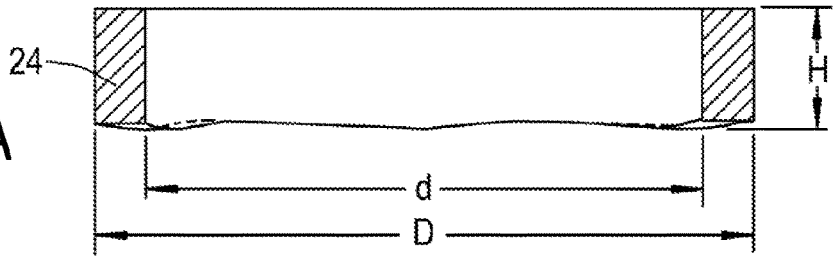
FIG. 3A is a section view of a TOMA Wedge ring.

When well tubulars are expanded downhole in deep-water or onshore wells, the bottom-hole assembly (BHA) with the expansion cone or cones sometimes could get anchored or stuck downhole. In such situations, it is desirable to disconnect the stuck Bottom Hole Assembly (BHA) with the stuck expansion tool from the upper part of the drill string.

Therefore, a safety tool joint is placed adjacent to the BHA with the stuck expansion tool assembly, to disconnect the BHA at a desired point that prevents to break a joint in the inner string at a random point when left-hand rotation (or break out torque) is applied to the drill string. Thus, a minimum length of pipe (or tools) left in the hole BHA to reduce the issues of sidetracking or fishing.

While drilling or reaming operations, the tool joints can be over-torqued downhole dynamics.

In some drilling rigs, the available left-hand torque capacity is limited, and since the break out torque (or left-hand torque) increases proportional with the make-up torque (or right-hand torque), the rig might not deliver sufficient left-hand torque from surface to desired point at downhole to be able break out the inner string at the safety tool joint location. This would lead to issues mentioned above.

Additionally, downhole make up capability is required for safety tool joints used in the MOno-Diameter (MOD) well construction process. The operation procedure includes connecting a dedicated inner-string and BHA to each other downhole via safety tool joint.

The invention provides a low torque BHA release tool, which is named TOMA (TOothed MAte-ring), designed to transmit torque in either direction and withstand high right-hand torsional and axial loads in washover, drilling, and fishing applications.

The low torque TOMA BHA release tool according to the invention may be used to recover the full inner string from bottom hole assembly to surface, with a low break out-make up torque (BO/MU) ratio, whenever disengagement becomes necessary with a simple design, and provide easy release, as well as, downhole re-make up if needed.

The TOMA BHA release tool according to the invention provides an easy back-off safety system, which can be integrated in standard inner strings, as well as, Mono Diameter (MOD) expansion system inner-strings and can be used as a dedicated sub.

The TOMA low torque release joint according to the invention is represented in FIG. 1 with quarter section view and of four main elements (1)-(4):

- a lower box section with an internal thread (1);
- an upper pin section with an external thread (2);
- a seal accomplished by either ends by O-ring seals (3); and
- wedge-type rings (4) at shoulder including two optimized mating geometries between these box and pin sections.

The invention focuses at the wedge-type rings (4), which can be integrated in commercially available—standard—safety joints, and their BO/MU ratio performance can be improved by adapting its design parameters to those safety joint designs (1, 2, 3).

The lower TOMA box section (1) has a pin connection (5) down for connecting to the tool joint and an internal (female) coarse thread to connect in the upper pin section (2). The upper pin section (2) has a box connection (6) up for connecting to the pipe and external (male) coarse thread, which matches the internal thread in the box section. The coarse thread form in the tool provides a reliably strong thread structure and easy back-off and smooth re-engagement capability. When the safety tool joint made up securely, the coarse thread profiles in box and pin sections mate and grip each other such that the relative movement of box and pin section due to make up process pulls and presses the mate surfaces to create a firm contact. The thread assembly and pin & box sections provide sufficient tensile rating to operate safely under heavy loads during expansion process, as well as, its solid body design can cope with cyclic downhole torques and axial loads without permitting to loosen of the threads. A semi-circular shaped stress relief groove is machined in pin section at external shoulder root area, where the pin section shoulders to box section to reduce the stress concentration and to improve the fatigue lifetime. The location and dimensions of the groove doesn't compromise the torsional and tensile capacity of the system. Round off features are incorporated in the coarse thread for to mitigate the stress concentration at the thread roots.

O-rings are accommodated in pin section (2), positioned at above and below the threads, to withstand external and internal pressures, and to ensure hydraulic integrity, as well as, keep threads free from debris.

Figure 3B:
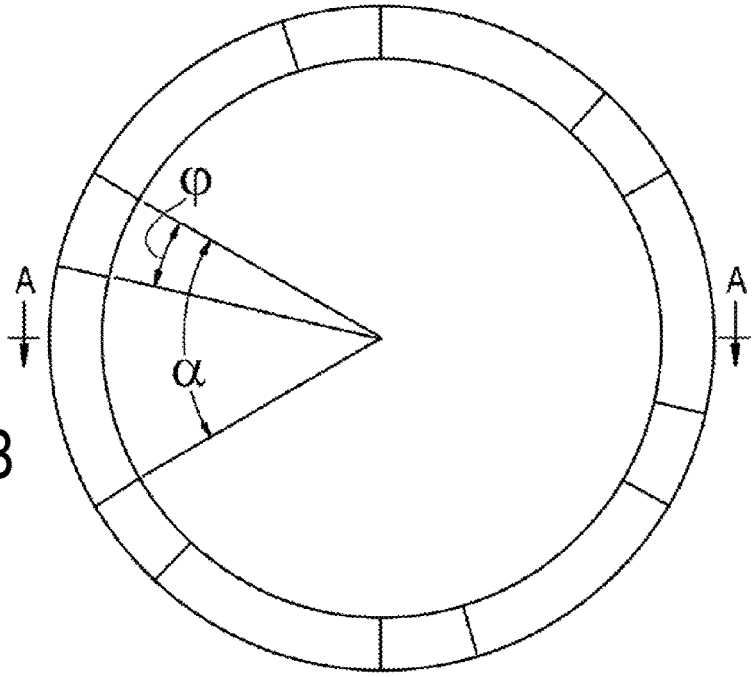
FIG. 3B is a top view of the TOMA Wedge ring of FIG. 3A.
Figure 4A:
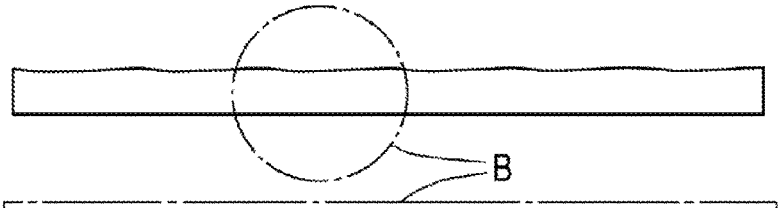
FIG. 4A is a side view of a TOMA Wedge ring.
Figure 4B:
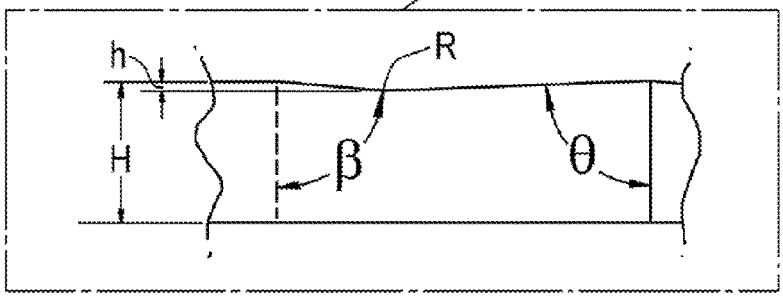
FIG. 4B is an enlarged vim of a part of FIG. 4A as indicated.

FIGS. 2A-C show schematics of the wedge-type rings in the TOMA tool according to the invention. FIGS. 3 and 4 show different views and features of the low break out safety joint according to the invention.

Wedge-type rings between the box and pin sections provide torque transmission and integrity until back-off procedure is initiated. Note that the torque transmission between the pin and box section, and across the rings, is as with commercially available—standard—safety joint.

The wedge angles of the TOMA tool according to the invention are optimized to achieve desired break out torque required with respect to the left-hand downhole torque application capability. The schematic of the wedge-type rings are shown in FIG. 2. The wedge-type rings (24) are shouldered to the lower box section (21) and the upper pin section (22). The majority of the surface torque to downhole is transferred from the upper pin section, via wedge-type rings, to the box and the remaining part of the surface torque is transmitted via the pin threaded section to the threaded section of the box. The contact surfaces in the wedge-type rings are firmly mated at the load angle wedge (26), which provides right-hand torque resistance by projecting the axial load generated due to make up into sliding resistance over the wedge. The relief angle wedge (25) is free of contact to eliminate additional counter force during break out.

In FIGS. 3 and 4, preferred dimensions of the TOMA low torque BHA release joint according to the invention are presented.

The outer diameter (OD), 'D', is selected as the same OD of the pin section to have a flush transition for run-in hole purposes and avoid debris accumulation at upsets. The inner diameter (ID), 'd', is set to the OD of the sealing area in the pin section to complete sealing mechanism. The height of the rings, 'H', is selected to provide sufficient material volume in case the rings are integrated to the box and pin sections by i.e. welding or locked by key-slots.

Various methods to integrate the wedge-type rings to commercially available—safety—safety joints are described in the following section.

In standard safety tool joints with a flush shoulder (without wedge-type rings), the break out torque is directly proportional to the applied make up torque, such that the increase in make up torque result in high break out torque likewise. This is realized by transforming the axial load generated by the make up torqueing into normal force on the coarse threads and external shoulder of the box and pin sections. Force diagrams of safety tool joint with wedge-type rings can be depicted for make up and break out conditions. During make up process while the normal force, 'N', acting on the threads are similar to the standard designs, the resulting normal force, 'Nt', on the wedge-type rings are governed by the load angle wedge, '(90°-β)'. The sliding motion due to right hand torque generates a counter frictional force is the product of the coefficient of friction, 'μt' with the normal force acting on the wedges. The load angle wedge and coefficient of friction are collaboratively influencing BO/MU ratio.

At low friction coefficient ranges, self-releasing condition can be reached, which means when the rotational force on the wedge is removed, the load on the wedge-type-rings will lower itself by causing to spin backwards without any external effort. Therefore, the friction coefficient at the surface of the wedge-type rings is required to be selected to result in a positive torque to lower the load on the wedges. On the contrary, increasing the friction coefficient increases the break out torque at a given make up torque, thus increase BO/MU ratio. Similar to the friction coefficient, the load angle leads to self-releasing at steep angles, because the overall mechanism works as torque transmission instead of tightening and locking up the pin and box sections.

The relief angle wedge, '(90°-θ)', is required to be smaller than the helix angle, λ, of the coarse threads in the box and pin section such that the wedge unscrews at a higher rate than the coarse thread itself and there is not additional sliding resistance created when left-hand rotation is applied because these surfaces are free of contact.

The height of the wedge tooth, 'h', is set to be smaller than the pitch of the coarse threads in the main body to ensure that the wedge-type of rings will have a complete contact at one or less right-hand revolution and prevent the edge peaks clash each other of the rings.

The circumferential angles, 'φ' and 'α' are selected to accommodate the load angle wedge, relief angle wedge and height of the wedge tooth (and number of wedge teeth (nt), respectively). All peaks and valleys of the wedge-type ring are designed to be in direction of the center of the ring to facilitate the tangential forces generated during right-hand rotation torqueing. And, all the sharp corners are rounded off at the valleys to mitigate stress concentrations, and fillets are applied at peaks to eliminate sharp corners smearing out the lead angle wedge surface when working against each other. The wedge-type rings are machined to have a helical profile to ensure a complete contact of mating surfaces and provide compliant working with the coarse thread in the body.

The high strength steel material of the wedge rings is selected to sustain the service of the component in corrosive and dirty environment; and also to have protection against impact forces, high contact stresses and/or sliding-wear while maintaining mechanical properties under downhole elevated temperatures. A heat treatment procedure and coating process are applied to the contact surfaces of the wedge rings to prevent galling when two surfaces are working and sliding in relatively opposite directions.

Analytical calculations were made in which the load angle wedge and friction coefficient (at the coarse thread section and on the contact surface of wedge-type rings) is varied to optimize the BO/MU ratio under the consideration of the yield stresses at the weak cross-section of the pin when the pin is in tension due to make up, thus ramp up on wedge-type rings and contact stresses action on the wedge surfaces due to compression forces across the wedge-type rings. These calculations generated a TOMA design of which key dimensions are:

Load wedge angle (90°-β): 5 degrees
Relief wedge angle (90°-θ): <thread helix angle
Friction coefficient at coarse threads (μ): 0.07-0.16
Friction coefficient on the contact surface of wedge-type rings (μt): 0.06-0.14
Tooth height (h): <pitch
Number of wedge teeth (nt): 6

As indicated the wedge-type rings of the TOMA BHA release tool according to the invention can be integrated to commercially available—standard—safety tool joints by various methods, such as:

Welding or machining these features in box and pins sections as one piece;

Using key-slots or bolted connection to provide a clutch-type engagement, as well as, tolerates relatively small movement/chatter, due to down-hole drilling/reaming torques, at circumferential and axial directions within the structure; thus mitigating the risk of cyclic loading over the time and fatigue issues. In this case, stress relieve and stress concentration features are included in the design to absorb shock-loads, as well as, the surface of the connecting tools are upgraded with case (surface) hardening of the material. The case hardening process will provide a relatively soft core that can absorb stresses, and eliminates cracking, as well as provides wear resistance on the surface.

Using hard particles (i.e. Tungsten Carbide, zirconium silicate) between the wedge-type rings and shoulder section of box and pin section, at 'Contact 1 and 3', to lock in position mechanically by creating very high frictional counter surfaces, Apply standard pipe dope (lubricant) on contact surfaces to reduce the friction coefficient. In this way, when right-hand rotation is applied to the safety joint during make up process, these lubricated (low friction coefficient) contact surfaces facilitate rotational movement of the box and pin sections relative to the wedge-type rings, while the 'Contact 2' of the wedge-type rings stands still due to higher friction coefficient of metal to metal contact; thus full-contact surface is maintained when the safety joint is made up. Maintaining a full-contact surface in wedge-type rings benefit the structural integrity by means of high contact stress resistance on surfaces at load angle wedge due to larger contact area.

A series of tests have been carried out to assess the performance of the TOMA safety tool joint with wedge-type rings with load wedge angle, '(90°-β)', of 5 degrees. Make up/break out power tongues were also are used in the tests. At every test data point, same preparation procedure, as in operations, has been applied to the safety tool joint such that the safety tool joint is cleaned free off dope, and re-apply dope prior to make up. Further benchmark tests have been carried out for various types of commercially available—standard—safety joint designs, including flush shoulder, toothed ring version and wave shoulder (sine-like wave profile) across the box and pin sections, to investigate the break out to make up torque ratio (easy back-off at left-hand rotation). The test results indicated that the average BO/MU ratio of the commercially available—standard—safety joints is found to be around 55 to 60%. When the wedge-type rings are used in a safety joint with flush shoulder, the break out to make up torque ratio is significantly reduced down to less than one third of what a commercially available—standard—safety joints can deliver.

Prototype experiments confirmed that the operational procedure at downhole to make up, break out (back-oft), or re-make up (re-engagement) of the TOMA BHA release tool according to the invention is simple and similar to the commercially available safety tool joints. When the bottom hole assembly is hang-off in well with the box section of the safety tool joint is on top, run in hole the inner string with pin section is at bottom and tag the bottom hole assembly. Apply right-hand rotation to make up the inner string to bottom hole assembly. To disengage and back-off, apply left-hand rotation to break out the connection. To re-engage and make up after complete back-off, come back and tag bottom hole assembly and apply right-hand rotation to make up the safety tool joint connection.

The TOMA BHA release joint may comprise a toothed-mono ring, wherein the toothed-mono ring resembles a set of inter-connected beams. These so-called beam structures connect the tips of the teeth of the ring at both sides with an angle. When right-hand rotation is applied to the safety tool joint, the beams are rotated at a hinge-point at the neutral axis of the ring. As the beams are rotated, an elastic energy is stored in the ring due to material elastic deformation. When break out procedure is initiated, the elastic stored energy acts as spring back to rotate left-hand that the system gains an extra energy to break out the safety tool joint. Therefore, the required break out torque is lessening by the aid of the elastic stored energy. The teeth features are in triangular shape with two main angles that determines the stiffness of the teeth. Together with the ring stiffness, the overall stiffness of the system is the limit-line on the capacity the so-called beams can be loaded and rotated. When the system saturates that the beams are not further rotated, the torque transmission is initiated. During make up process, while the pin and box section is rotating in the right-hand direction and displaces relative to each other, thus generates compressive forces on the ring when shouldered at pin and box section. In order to initiate the rotation process of the beams, the rotational forces must be substantially higher than the compressive forces depending of the angle of the beams; otherwise the ring (and teeth) is compressed before rotation. Therefore, a critical limit angle between the tip of the teeth of the ring and the friction coefficient between the ring and the pin and box section shoulders are the key parameters.

If the available left-hand rotation capacity to apply break out torque is limited, the flush shoulder type tools (no additional component or feature other than box and pin section) cannot be used due to their high break out—make up ratio. Moreover, modifying the internal and external thread dimensions for this configuration doesn't provide a significant reduction for the break out torque, The performance of the friction-ring type tools is very sensitive to the geometry of the triangular shaped features. The stiffer features can provide locking at right-hand direction rather than providing left-hand break out torque advantage. Moreover, these features establish line contact (instead of area contact) to the box and pin shoulder that generates higher contact stresses as the contact area is reduced. In this case, the corners of these features could be deformed and flatten out, which can lead to under-performance, thus higher break out torques. In addition, in these types of design debris can accumulate and penetrate in the sealing area that can result in poor sealing performance over the time, as well as the debris can affect the break out performance by changing the frictional (tribological) property of the shoulder when left-hand torque is applied.

The shear-out type of tools cannot be made up downhole, thus cannot be used in monodiameter wells, and cannot be used multiple times unless pulled out to surface and its shear pins are redressed, thus result in higher operational costs by tripping in and out.

The TOMA BHA release joint according to the invention enables to use a safety joint in rigs, where there is not sufficient left-hand rotation capability available to break out, while right and left-hand direction torque transmission is required, as well as, work under tensile and compression axial loads.

The TOMA design is simple and can be easily integrated in commercially available—standard—safety joints to improve their break out capability, while not changing the existing operational procedure of monodiameter (MOD) wells.

The TOMA break out torque is lowered by optimizing the wedge shoulder geometry.

The TOMA design can transmit high right-hand torque during drilling or reaming, while minimizing the effect of downhole torqueing on the break out torque.

This TOMA safety tool joint can be re-made up downhole without tripping out.

The TOMA wedge shoulder establishes a full coverage when the safety tool joint is made up that provides an area contact, thus reduction in contact stresses, as well as, eliminates deformation or flattening out, which provides a stable break out performance at multiple uses.

Therefore, the method, system and/or any products according to present invention are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

What is claimed is:

1. A screw threaded safety joint for releasably connecting a Bottom Hole Assembly (BHA) of a tubular expansion assembly to a drill string, comprising:

a lower box section comprising a pin connection for connecting to a pipe of the drill string;

an upper pin section comprising a box connection for connecting to a tool joint of the BHA;

said box section comprising an internal coarse thread and said pin section comprising an external coarse thread which matches the internal coarse thread in the box section; and a pair of intermeshing wedge-type rings shouldered to the lower box section and the upper pin section, with intermeshing sawtooth profiles on mutually abutting cross sectional surfaces, said profiles having a plurality of load angle wedges facing the rotation direction when screwing the box section and the pin section together, separated by relief angle wedges between successive load angle wedges, wherein the load angle wedges have a load wedge angle (90°-β) larger than a relief wedge angle (90°-θ) of the relief angle wedges, wherein said load wedge angle (90°-β) denotes an included angle between a contact surface of the load angle wedges and said rotation direction when screwing the box section and the pin section together, and wherein said relief wedge angle (90°-θ) denotes the included angle between the contact surface of the relief angle wedges and the rotation direction when screwing the box section and the pin section apart.

2. The screw threaded safety joint of claim 1, wherein the load angle wedges are substantially flat.

3. The screw threaded safety joint of claim 2, wherein the load wedge angle (90°-β) is between 4 and 6 degrees.

4. The screw threaded safety joint of claim 1, wherein relief wedge angle (90°-θ) which is smaller than a thread helix angle of the coarse threads.

5. The screw threaded safety joint of claim 1, wherein a friction coefficient at the coarse threads (μ) is between 0.07 and 0.16.

6. The screw threaded safety joint of claim 1, wherein the sawtooth profile of each wedge-type ring has a friction coefficient on the contact surface of wedge-type rings ($\mu_t$) between 0.06 and 0.14.

7. The screw threaded safety joint of claim 1, wherein the sawtooth profile of each wedge-type ring has a tooth height (h) smaller than a pitch of the respective internal coarse thread and external coarse thread.

8. The screw threaded safety joint of claim 1, wherein the sawtooth profile of each wedge-type ring has 6 wedge teeth ($n_t$).

9. The screw threaded safety joint of claim 1, wherein a majority of the torque from the drill string to the BHA is transferred from the upper pin section, via the wedge-type rings, to the lower box section, wherein the remaining part of the torque is transmitted via the internal and external coarse threads.

10. The screw threaded safety joint of claim 1, wherein contact surfaces in the wedge-type rings, when mated at the load angle wedges, provide right-hand torque resistance.

11. The screw threaded safety joint of claim 10, wherein the right-hand torque resistance is provided by the axial load generated due to make up being projected into sliding resistance over the load angle wedges.

12. The screw threaded safety joint of claim 10, wherein relief angle wedges are free of contact, to eliminate additional counter force during break out.

13. The screw threaded safety joint of claim 1, wherein peaks and valleys of the wedge-type rings are in direction of the center of the wedge-type rings to facilitate tangential forces generated during right-hand rotation torqueing.

14. The screw threaded safety joint of claim 13, wherein corners are rounded off at the valleys to mitigate stress concentrations.

15. The screw threaded safety joint of claim 14, wherein fillets are applied at peaks to eliminate sharp corners smearing out the lead angle wedge surfaces.

16. The screw threaded safety joint of claim 1, wherein one of the pair of wedge-type rings is mechanically locked in position with a shoulder section of the lower box section and one of the pair of wedge-type rings is mechanically locked in position with a shoulder section of the upper pin section.

17. The screw threaded safety joint of claim 16, wherein the wedge-type rings are mechanically locked in position using hard particles.

18. The screw threaded safety joint of claim 16, wherein the wedge-type rings are mechanically locked in position using particles of tungsten carbide or zirconium silicate.

19. The screw threaded safety joint of claim 1, further comprising O-ring seals at either end of the internal and external coarse threads.

20. The screw threaded safety joint of claim 19, wherein O-rings are accommodated in the upper pin section, positioned at above and below the coarse external threads.

21. The screw threaded safety joint of claim 20, wherein at least one of the O-rings engages with the wedge-type rings against an inner diameter thereof.

* * * * *